United States Patent [19]

De Beau et al.

[11] 4,074,734

[45] Feb. 21, 1978

[54] LIQUID DELIVERY SYSTEM

[75] Inventors: Gerard Anthony De Beau, Buena Park; Harold Arnold Price, Orange, both of Calif.

[73] Assignee: Union Oil Company of California, Los Angeles, Calif.

[21] Appl. No.: 707,034

[22] Filed: July 20, 1976

[51] Int. Cl.[2] ..... B65B 3/18

[52] U.S. Cl. ..... 141/44; 55/160; 55/170; 55/274; 73/200; 141/52; 141/104; 141/192

[58] Field of Search ..... 73/198, 200, 229; 141/44–46, 52, 59, 94, 93, 279, 284, 290, 301–304, 311 A, 374, 392, 192, 9, 99, 100, 104, 105, 251, 252, 260; 222/20, 144.5, 71–74; 55/160, 170, 274

[56] References Cited

U.S. PATENT DOCUMENTS

| | | | |
|---|---|---|---|
| 867,587 | 10/1907 | Moore | 73/200 X |
| 2,093,952 | 9/1937 | Brubaker | 73/200 X |
| 2,276,838 | 3/1942 | Grise | 73/200 |
| 3,926,231 | 12/1975 | Madden et al. | 141/59 X |

*Primary Examiner*—Richard E. Aegerter
*Assistant Examiner*—Frederick R. Schmidt
*Attorney, Agent, or Firm*—Gregory F. Wirzbicki; Lannas S. Henderson; Richard C. Hartman

[57] ABSTRACT

A system is provided for delivering any of two or more liquids from their respective storage tanks into a tank truck or the like while avoiding contamination of the liquid being delivered with any significant amount of a previously delivered liquid. Means are provided for collecting vapor from the tank truck and for minimizing evaporation losses of the liquid being delivered.

3 Claims, 2 Drawing Figures

FIG. 1

TO VAPOR REMOVAL
TO VAPOR REMOVAL
TO VAPOR REMOVAL

LIQUID DELIVERY SYSTEM

BACKGROUND OF THE INVENTION

1. Field of the Invention

Many industrial operations involve the transfer of bulk liquids from storage tanks into tank trucks, tank cars, or other storage vehicles. Usually, such transfers are made through a liquid delivery system that is common to two or more storage tanks holding different liquids. The present invention is directed to such a delivery system, and is particularly concerned with providing means for transferring any of several liquids without contaminating the liquid being transferred with any significant amount of a previously delivered liquid. It is also concerned with providing means for minimizing evaporative losses and for recovering vapors during such transfer.

2. Description of the Prior Art

In industries that sell an assortment of bulk liquid chemicals, transfer of such chemicals from storage tanks into tank trucks, railroad tank cars, or other storage vehicles is frequently necessary. In most cases, such transfers are made through a single liquid delivery or dispensing system. Strangely, however, such systems seldom have means integrated therewith for measuring the amount of liquid transferred therethrough; instead, the amount of liquid so transferred is determined by weighing the storage vehicle before and after the filling of its storage tank, or by filling said storage tank up to a predetermined liquid level.

The primary reason that the amount of transferred liquid is measured by such methods is that the most widely employed liquid metering means, the positive displacement, nutating-piston meter, if employed in such a liquid delivery system, would, during the subsequent draining of said system, entrap a significant amount of liquid in both the nutating meter itself and its associated piping. The total amount of liquid so entrapped may range between about 3 and 5 gallons, assuming the meter is of commercial size. Hence, a liquid delivery system incorporating such a meter could not be effectively utilized to transfer any of a plurality of liquids because, after a first liquid is transferred, none of the others could be transferred through the same system without being contaminated with a significant amount of said first liquid.

Another problem inherent in using commercially available liquid delivery systems resides in the vapor removal means usually employed therewith to remove vapors emitted from the liquids entering the vehicle storage tank. The presently accepted means for removing such vapors entail means for (a) sealing the gases within the storage tank from the surrounding atmosphere and (b) drawing said gases out of the storage tank during the filling thereof with liquid. While such means are effective for removing the vapors, they also totally obstruct a workman's view into the vehicle storage tank, thereby increasing the likelihood of flooding the vapor removal means with liquid or filling the entire vehicle storage tank with the wrong liquid. Moreover, environmental protection agencies in some states, including the State of California, require that vapor withdrawal from vehicle storage tanks in the manner described (i.e., by sealing the vapors from the surrounding atmosphere) be accomplished at a pressure substantially less than atmospheric, thus resulting in the volatilization and loss of more of the liquid entering the storage tank than would occur if the vapor removal were accomplished at essentially atmospheric pressure.

It is accordingly an object of this invention to provide a liquid delivery system capable of transferring an accurately measured amount of a liquid from one vessel to another while avoiding contamination of said liquid with any significant amount of a liquid previously transferred through the same system. Another object is to provide, in such a delivery system, means for collecting vapors evolved from the receiving vessels while permitting visual observation of the operation. A further object is to provide, in such a system, means for minimizing the amount of liquid vaporized during delivery. Other objects and attendant advantages will be apparent from the following detailed description of the invention.

SUMMARY OF THE INVENTION

The apparatus of this invention comprises a liquid delivery system to be utilized for transferring accurately measured amounts of any of a plurality of separately stored liquids into receiving vessels without the transferred liquid being contaminated in said system with a significant amount of a previously transferred liquid. The transfer of an essentially uncontaminated, accurately measured amount of a liquid is insured by incorporating a turbine meter of high accuracy in a liquid delivery system comprising a pump and a liquid loading arm. Such meters are essentially completely drainable through a fluid communication path including their intake and discharge openings; hence, when the entire liquid delivery system must be drained after the passage of a liquid therethrough, no liquid will be "held-up" either in the meter or its associated piping.

The delivery of an accurately measured amount of a liquid is insured not only by the use of a turbine meter of high accuracy but also by the use of means for removing entrained gases from a liquid prior to its passage through said meter. Additionally, a control valve is used in conjunction with said turbine meter to insure that only an entrained gas-free liquid passing through said valve is measured by said turbine meter and delivered to the receiving tank.

Vapor removal means, comprising a vapor collection head situated on said loading arm, a fan, and suitable conduits for transporting gases from said vapor collection head to said fan and from thence to suitable vapor disposal facilities, are included in the apparatus of the invention. The vapor collection head, however, when placed in position on the rim of the receiving tank hatchway, is designed not to effect a vapor-tight seal between the gases in said receiving tank and the surrounding air, thereby providing for viewing into the tank and for removing vapors therefrom at essentially atmospheric pressure.

DETAILED DESCRIPTION OF THE INVENTION

Figure 1:
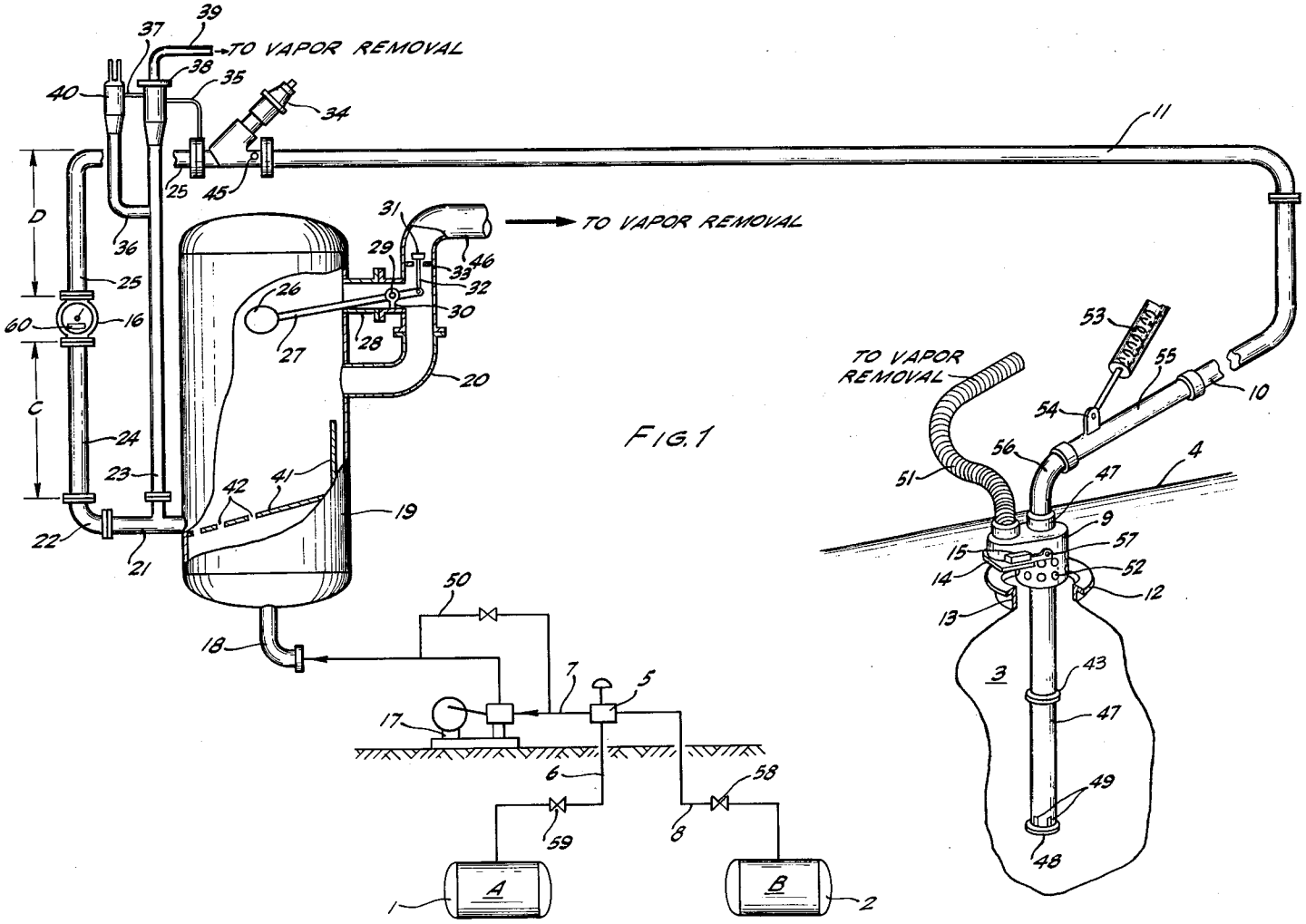
FIG. 1 shows, partially in schematic form, a preferred embodiment of the apparatus of this invention and includes the major components of the equipment employed, some of which are shown in breakway and/or cutaway views.

As shown in FIG. 1, the apparatus of the invention comprises gas eliminator tank 19 which is connected via line 18 to a plurality of liquid storage tanks. Liquid is transferred from the storage tanks to a receiving tank 3 via gas eliminator tank 19, tee 21, elbow 22, line 24, turbine meter 16, line 25, control valve 34, line 11, and loading arm 10. Vapors are removed from receiving tank 3 into line 51 via vapor collection head 9, which engages only an arcuate portion of rim 12 of hatchway 13, thereby providing atmospheric communication with the interior of said tank.

To describe the invention with more particularly, FIG. 1 shows two underground storage tanks 1 and 2, liquid A being stored in tank 1 and liquid B in tank 2. To pump a measured quantity of liquid A into tank 3 of tank truck 4 valve 59 is open, valve 58 is closed, and three-way valve 5 is set to deliver liquid through lines 6 and 7 and to block any flow of liquid through line 8.

Figure 2:
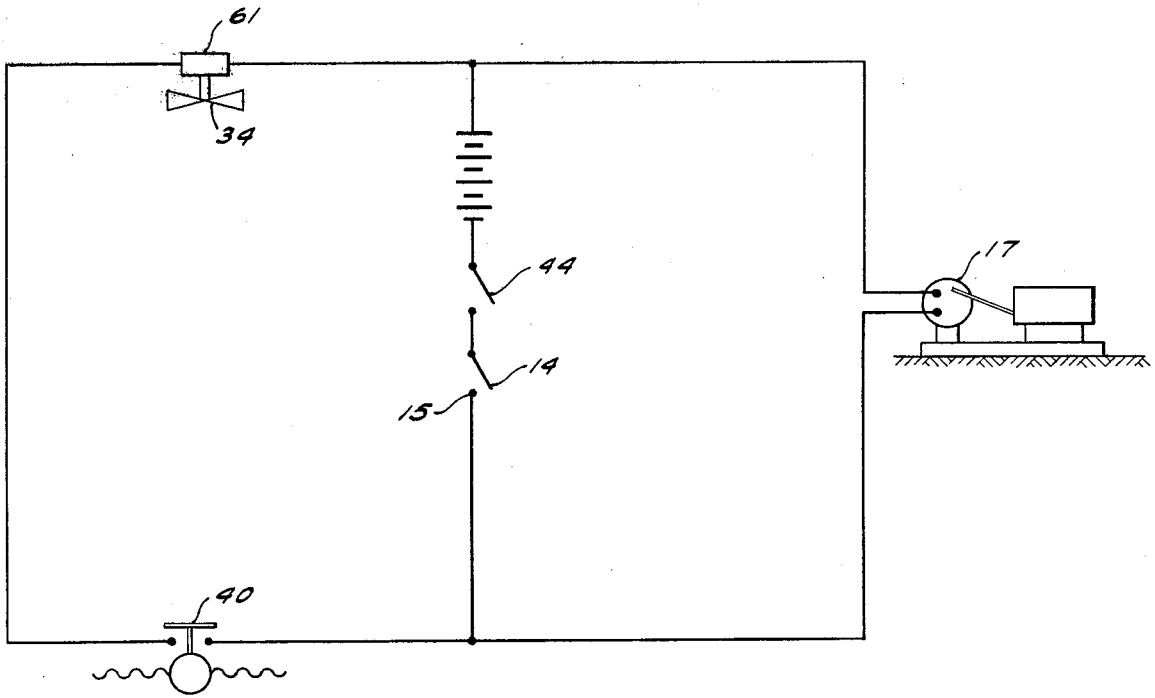
FIG. 2 is an electrical diagram showing the control circuitry for the apparatus of FIG. 1.

When vapor collection head 9 engages the rim 12 of the hatchway 13 leading into tank 3, switch lever 14 rotates about pintle 57 and contacts electrical terminal 15. When gallonage counter 60 in turbine meter 16 is set to record the passage of a specified number of gallons of liquid, which setting closes switch 44 located within said turbine meter 16, the electrical circuit shown in FIG. 2 is completed and positive displacement pump 17 is activated. Liquid A is then pumped upwardly through line 7 and forced into pipe 18 leading into gas eliminator tank 19 containing, as shown in a partial cutaway view, a baffle 41 with drain holes 42. As the liquid rises in tank 19, it also passes into drain return line 20, tee 21, elbow 22, vent line 23, lines 24 and 25, and turbine meter 16. Eventually it forces float 26 to rise. When the liquid reaches a level such that float arm 27, which is pivotably mounted in pipe 28 to two suitable carriages (one shown as reference numeral 30) by means of two trunnions (one shown as reference numeral 29), assumes a substantially horizontal position, valve head 31, drawn by stem 32, seats against the top of annular valve seat 33.

Once valve head 31 is seated as described, liquid is forced to continue rising only in vent line 23 and line 25. With control valve 34 being in the closed position, the liquid rising in line 25 will force air and other gases into air vent tube 35, which is situated to pass such gases from the high point of line 25 into vapor removal line 39 via conventional air vent float valve 38. (A suitable float valve for purposes herein is a Brooks-Brodie Model No. W 180215). Meanwhile, rising liquid in vent line 23 also forces air into line 39, firstly by displacing air in vent line 23 itself, and secondly by displacing air in float switch arm 36 through conventional float switch 40, air bleed line 37, and float valve 38. When the liquid level in vent line 23, line 25, and arm 36 reaches a height such that liquid is just beginning to enter air vent tube 35 from line 25, air vent float valve 38 closes, thereby shutting off the flow of gases into line 39. Simultaneously, float switch 40 closes, thereby completing a second electrical circuit shown in FIG. 2, which completed circuit energizes solenoid 61 within control valve 34 so that said valve opens to allow the flow of liquid into line 11.

Liquid now passes into tank 3 of tank truck 4 through line 11 and loading arm 10, the latter being comprised of loading arm conduit 55, elbow 56, and sliding pipe 47. It is preferable that the tank be filled from the bottom so that vaporization of liquid due to aeration effects is minimized; consequently, sliding pipe 47 is pushed through vapor collection head 9 until stop ring 48 contacts the floor of tank 3, thereby introducing liquid into the bottom of said tank through discharge holes 49.

The amount of liquid pumped into tank 3 is volumetrically measured by turbine meter 16 and recorded on gallonage counter 60. Preferably, a turbine meter is used that is at least accurate to within $\pm$ 0.05 vol. % of the amount of liquid delivered; such meters may be obtained commercially. As those skilled in the art will realize, turbine meters depend for their accuracy upon a "straightened" flow of liquid passing therethrough. Hence, lines 24 and 25 are of sufficient lengths C and D, respectively, to provide the necessary straightening effect for turbine meter 16. Additionally, line 24 may contain internal straightening vanes to aid in this purpose.

When the predetermined number of gallons has been pumped through control valve 34 and been recorded by the gallonage counter 60, an appropriate trip mechanism, such as a relay, not shown, in turbine meter 16, will trip switch 44, thereby shutting down positive displacement pump 17 and de-energizing solenoid 61 so that control valve 34 closes. To insure that the required quantity of liquid passes through control valve 34, it is preferred that the specified number of gallons initially set on gallonage counter 60 includes the constant number of gallons that pass through turbine meter 16 prior to the opening of control valve 34. For example, if 1500 gallons are desired to be delivered and 5 gallons will pass through turbine meter 16 prior to the opening of control valve 34 as previously described, then it is necessary to set gallonage counter 60 to record the passing of 1505 gallons to insure that the proper amount is delivered. Alternatively, gallonage counter 60 can be so adjusted that it "zeroes" when 5 gallons has passed therethrough. In such an embodiment, it is only necessary to set gallonage counter 60 at 1500 gallons to insure that the desired quantity of liquid passes through the control valve 34.

When control valve 34 closes in response to the tripping of switch 44, a portion of the specified delivery of liquid will be held within line 11 and loading arm 10. To drain this entrapped liquid into tank 3, control valve 34 is equipped with a conventional diaphragm actuated, vacuum breaker valve 45, which opens to the atmosphere when the negative pressure exerted on said valve 45 by the entrapped liquid is detected. The force of gravity then drains the remaining portion of the specified delivery as indicated on gallonage counter 60 into tank 3.

The accuracy with which the amount of liquid transferred into tank 3 is measured herein depends not only upon utilizing a turbine meter of high accuracy but also upon insuring that the liquid passing through turbine meter 16 contains no entrained gases, which may otherwise introduce significant errors in the reading shown on the gallonage counter 60. Accordingly, means are incorporated herein for preventing the passage through turbine meter 16 of any significant volume of entrained gases. Any entrained air or other gases entering tank 19 during the delivery of a liquid (e.g., by the introduction of air through the seals of pump 17) are collected in the upper portion of tank 19, and when a sufficient amount collects therein so as to lower float 26, they are automatically discharged via line 46. Moreover, in the rare event any entrained gases do enter tee 21, most of such gases will bubble up line 23, thereby tripping float switch 40 and closing control valve 34, the latter of which re-opens only when rising liquid once again forces essentially all the gases that entered tee 21 out line 39. Thus, by eliminating gases from the liquid prior to its passing through turbine meter 16, and by providing for immediate shutdown in the event that some gases do enter tee 21, the reading shown on gallonage counter 60 always reflects the true amount of liquid passed through control valve 34; hence, extremely accurately measured deliveries of a liquid transferred into tank 3 are obtained. (One embodiment of the invention as described was found to be accurate within ± 1 pint per 500 gallons pumped at a rate of about 150 gpm. For purposes herein, however, an accurately measured delivery is obtained when the amount of a liquid delivered into a receiving vessel at a rate between about 10 and 200 gpm is within about ± 0.1 vol. % of the amount indicated by the turbine meter or other liquid metering means hereinafter defined.)

An essential feature of the invention is its drainability, which allows the transfer of the second liquid, liquid B, through the same liquid delivery system as was used to transfer liquid A without therein contaminating liquid B with any significant amount of the previously transferred liquid A. As shown hereinbefore, liquid A entrapped downstream of control valve 34 is removed by the automatic opening of vacuum breaker valve 45. The remainder of the liquid delivery system is drained through valve 59 by operating (by means of an electrical circuit not shown) positive displacement pump 17 in reverse. Since positive displacement pumps can be used to pump and compress air, essentially all the remaining liquid entrapped in the delivery system may be pumped back through valve 59, which is then closed. Alternatively, the force of gravity alone may be utilized to drain this remaining liquid entrapped in the liquid delivery system if pump 17 is capable of being drained in a reverse direction, and if no component of said system between valve 59 and control valve 34 is designed to retain a liquid draining freely by the force of gravity. However, reverse draining through the pump in this manner alone may be too slow; hence, bypass line 50 is provided to increase the flow of liquid into the respective storage tanks.

The essentially complete draining of the liquid delivery system by the methods herein described is dependent upon the use of a turbine meter 16, or other liquid metering means having its intake and discharge openings terminating the ends of a fluid communication path passing through said metering means, through which openings and fluid communication path a liquid may pass without any significant amount thereof being entrapped therein or in any components associated with said liquid metering means. In essence, then, only those meters that will drain essentially completely through a fluid communication path passing through their intake and discharge openings, and that will permit essentially no "hold-up" of liquid either in themselves or in other parts of the liquid delivery system during the draining thereof, are contemplated for use in the invention. Specifically excluded as a component of the invention, therefore, is the most commonly used liquid metering means, the typical nutating-piston meter, the use of which, as stated hereinbefore, may cause the entrapment of between 3 and 5 gallons of liquid. If a subsequent 1500 gallon delivery of another liquid product were to be passed through a liquid delivery system comprising such a meter, the final product delivered would be contaminated with between about 0.20 and 0.33 volume % of a previously delivered liquid. Contaminations of this magnitude may be intolerable and are avoided when a turbine meter is utilized as a component of the apparatus of the invention.

After the liquid delivery system has been drained of liquid A as described, liquid B may then be safely transferred therethrough into a recovery tank without being contaminated with any significant amount of previously delivered liquid A. Preferably, the draining of the liquid delivery system has been so complete that, when liquid B is transferred therethrough, it will be contaminated with no more than that residual amount of previously delivered liquid A that clings to the interior walls of the liquid delivery system and is removable therefrom, if at all, only by evaporation. The amount of this evaporative residual of liquid A that will be present in said liquid delivery system immediately subsequent to the draining thereof will depend firstly upon the internal surface area of the delivery system, which for purposes herein should be at least 25 $ft^2$, preferably between about 100 and 300 $ft^2$. It will also depend upon the nature of the delivered liquid. For liquids boiling above about 200° F., usually no more than 50 cc will remain as an evaporative residual in a liquid delivery system having an internal surface area in the preferred range; however, if the liquid is a highly volatile organic liquid, such as hexane, kerosene, toluene, xylene, a mineral spirit, or gasoline, that tends rapidly to evaporate from the interior walls when air is drawn through the apparatus by the draining of the liquid delivery system, less than about 25 cc will remain as an evaporative residual in said system. For purposes herein, however, a liquid is delivered essentially uncontaminated with, or contaminated with less than a significant amount of, a previously delivered liquid when it is delivered in a state contaminated with no more than 250 cc of said previously delivered liquid in excess of the evaporative residual.

If liquid A or B is organic in nature, vapor removal may be necessary to satisfy local air pollution regulations. Accordingly, provision is made herein to prevent the escape of vapors therefrom during delivery into tank 3. Some are removed via lines 39 and 46 when the liquid delivery system is being initially filled and when float 26 or the float in float switch 40 is lowered due to the collection of gases as hereinbefore described. The removal of most vapors, however, is accomplished via line 51 leading to an air eduction means, such as a fan not shown, that draws vapors from tank 3 through openings 52 in vapor collection head 9, from which said vapors are carried by line 51 and induced by said air eduction means to conventional vapor recovery or disposal facilities, not shown.

It is emphasized that the vapor collection head 9 does not connect to hatchway rim 12 in vapor-tight fashion. Instead, it is preferred that it be designed so that, in use, it will sit on only a portion, preferably only a minor portion, of rim 12 and contact no portion of the inner surface of hatchway 13. Thus, the air eduction means draws a mixture of the vapors present inside the tank 3 and the air present outside said tank 3 into the collection head 9.

Two advantages reside in the use of a vapor collection head 9 of the preferred design. Firstly, it allows the person who is filling the tank 3 to see thereinto so that, if the wrong liquid is pumped or if there is danger of overflow, he can simply raise the loading arm 10, thereby disengaging switch lever 14 from electrical terminal 15 so that control valve 34 closes and pump 17 shuts down. Secondly, since the vapors are being withdrawn essentially at atmospheric pressure, rather than at a substantial negative pressure as would be the case when tight fitting collection heads are utilized, less liquid is vaporized; hence, the customer loses less of the purchased liquid, sometimes saving up to 1 gallon of the liquid in 500 gallons pumped, depending on the nature of the liquid.

A safety feature is introduced into the invention when the loading arm is suspended from an appropriate platform (not shown) by means of spring loaded device 53 (shown in cutaway and breakaway fashions), which is both pivotably connected to loading arm 10 at 54 and maintained in a state of tension whenever vapor collection head 9 contacts rim 12. Thus, if an accident should befall a workman holding the loading arm 10 such that he should lose his grip thereon, the entire loading arm 10 will spring upwardly a sufficient distance such that switch lever 14 disengages electric terminal 15, thereby causing control valve 34 to close and cease the flow of liquid into the tank. This may prevent the compounding of one accident into a second, especially if the liquid being pumped is highly flammable.

For ease in removing vapor collection head 9 from the truck tank 3, a second stop ring 43 is provided on sliding pipe 47. Hence, when the loading arm 10 is to be lifted out of tank 3, stop ring 43 will prevent the lower portion of sliding pipe 47 from being lifted without also lifting vapor collection head 9. Moreover, to accommodate all truck or rail car tanks into which liquid is to be delivered, stop ring 43 should be spaced from stop ring 48 so that for even the tank 3 of minimum depth, the vapor collection head 9 will sit on its rim 12 and stop ring 48 will contact its interior floor.

Alternative embodiments of the invention as described are possible. The storage tanks may be so elevated that the liquids may be gravity fed into receiving vessels, in which case a pump would only be necessary for returning liquids to said tanks. The turbine meter may be placed downstream of the control valve, and in this position, liquid hold-up in the meter would drain into the receiving tank. The control valve may be hand operated with control means only being necessary to close said valve in the event entrained gases should enter tee 21. Also, it is possible for the vapor collection head to be of the vapor-tight fitting variety provided the receiving tank is vented to the atmosphere by means of an opening other than the hatchway; hence, the vapors will still be removed from the tank at essentially atmospheric pressure and a workman can view thereinto through the vent opening. Accordingly, it is intended that all such alternatives, and others that are apparent to those skilled in the art in light of the foregoing description and fall within the spirit and scope of the appended claims, be embraced in the invention herein.

We claim:

1. An apparatus comprising:

(1) a plurality of storage vessels for separately storing a plurality of liquids; and (2) a liquid delivery system for transferring into a receiving vessel accurately measured amounts of any one of said stored liquids without the transferred liquid becoming contaminated in said system with a significant amount of a previously transferred liquid, said liquid delivery system comprising:

(a) a positive displacement pump;

(b) valving means, in liquid communication with said pump and each of said storage vessels, for directing the flow of a liquid in any one of said storage vessels into said pump;

(c) degassing means for removing entrained gases from a flowing liquid comprising (1) a holding vessel through which said flowing liquid is passed and in which entrained gases in said flowing liquid are gathered and (2) means, integral with said holding vessel, for discharging gas gathered in said holding vessel in response to the presence of accumulated gas contained therein;

(d) a first liquid transfer means connecting said pump and the intake of said holding vessel;

(e) a liquid metering means for accurately measuring the amount of a liquid passing through a fluid communication path within said liquid metering means, said fluid communication path (1) comprising the intake and discharge openings of said liquid metering means and (2) being constructed such that a draining liquid may freely pass through said fluid communication path without any significant amount thereof becoming entrapped therein;

(f) a second liquid transfer means connecting the discharge of said holding vessel and said intake opening of said liquid metering means;

(g) a control valve;

(h) a third liquid transfer means connecting said discharge opening of said liquid metering means with the intake opening of said control valve;

(i) means for opening said control valve when liquid is at the high point of that portion of said liquid delivery system consisting of said second and third liquid transfer means, said liquid metering means, said intake opening of said control valve, and the discharge portion of said holding vessel and for closing said control valve in response to the detection of entrained gas in liquids flowing through said second liquid transfer means, said means comprising:

(1) a gas communication passageway for discharging gases from said high point;

(2) a liquid collector line connected to said portion of said liquid delivery system, said liquid collector line extending upwardly from its connection to said portion of said liquid delivery system to a height at least equivalent to said high point;

(3) a valve, positioned in said gas communication passageway, said valve being responsive to a float situated within said liquid collector line such that said valve closes when liquid rises up said liquid collector line to a level equivalent with said high point; and (4) means, responsive to the level of liquid in said liquid collector line, for opening said control valve when said liquid level is equivalent to said high point and for closing said control valve when said liquid level is below said high point, said means comprising detecting means, attached to said liquid collector line, for detecting when liquid is present in said liquid collector line at a height equivalent to said high point;

(j) a fourth liquid transfer means, connected to the discharge of said control valve, for delivering essentially all liquid passing through said control valve into a receiving vessel; and (k) siphon-breaking means for draining all liquid entrapped in said fourth liquid transfer means into said receiving vessel when said control valve is closed, said siphon-breaking means comprising:

(1) an air inlet passageway connected to that portion of said liquid delivery system consisting of said discharge of said control valve and said fourth liquid transfer means;

(2) a valve situated in said air inlet passageway; and (3) means, integral with said valve, for opening said valve when a negative pressure exerted by entrapped liquid in said fourth liquid transfer means is detected, said means including means for detecting said negative pressure.

2. An apparatus as defined in claim 1 wherein said liquid metering means is a turbine meter.

3. An apparatus as defined in claim 1 wherein at least one of said stored liquids is a volatile organic liquid and said fourth liquid transfer means (2) (j) comprises:

(1) a liquid loading arm for discharging liquid into said receiving vessel;

(2) means for removing at essentially atmospheric pressure the vapors emitted from liquids discharged from said liquid loading arm into said receiving vessel, said means comprising a vapor collection head slidably mounted on said liquid loading arm such that said liquid loading arm may be pushed into said receiving vessel while said vapor collection head remains stationarily in contact with the rim of an opening into said receiving vessel, said vapor collection head being so constructed that, when said vapor collection head is in contact with said rim, vapors within said receiving vessel are in gas communication with the outside atmosphere; and (3) means, comprising an electrical circuit and a switching means attached to said vapor collection head for energizing said circuit when said vapor collection head is not in contact with said rim, for closing said control valve, said means being so integrated with said means (2) (i) hereinabove defined that said control valve cannot open unless said switching means is engaged.

* * * * *